US009651325B1

(12) United States Patent
Gant et al.

(10) Patent No.: US 9,651,325 B1
(45) Date of Patent: May 16, 2017

(54) UNIVERSAL TRIGGER LOCKING SYSTEM

(71) Applicant: JNA Innovators L.L.C., Mukilteo, WA (US)

(72) Inventors: Justin Gant, Mukilteo, WA (US); Nicholas Schmidt, Mukilteo, WA (US)

(73) Assignee: JNA Innovators L.L.C., Mukilteo, WA (US)

( * ) Notice: Subject to any disclaimer, the term of this patent is extended or adjusted under 35 U.S.C. 154(b) by 0 days.

(21) Appl. No.: 15/093,671

(22) Filed: Apr. 7, 2016

Related U.S. Application Data

(60) Provisional application No. 62/267,530, filed on Dec. 15, 2015.

(51) Int. Cl.
*F41A 17/06* (2006.01)
*F41C 23/16* (2006.01)
*F41A 17/46* (2006.01)

(52) U.S. Cl.
CPC ..... *F41A 17/06* (2013.01); *F41A 17/066* (2013.01); *F41A 17/46* (2013.01); *F41C 23/16* (2013.01)

(58) Field of Classification Search
CPC ..... F41A 17/46; F41A 17/48; F41A 17/22; F41A 17/06; F41A 17/066
USPC ..... 42/70.06
See application file for complete search history.

(56) References Cited

U.S. PATENT DOCUMENTS 5,636,464 A * 6/1997 Ciluffo ..... F41A 17/066 340/5.52
6,301,815 B1 * 10/2001 Sliwa ..... F41A 17/066 42/70.01
2002/0112390 A1 8/2002 Harling et al.
2007/0186457 A1 8/2007 Pitt
2007/0271831 A1 11/2007 Newkirk et al.
2008/0282595 A1 * 11/2008 Clark ..... F41A 17/06 42/1.01
2011/0309975 A1 * 12/2011 Chu ..... G01S 5/0027 342/357.25

(Continued)

FOREIGN PATENT DOCUMENTS

DE 102009057866 * 6/2011

OTHER PUBLICATIONS

International Search Report mailed Jan. 24, 2017, issued in corresponding International Application No. PCT/US2016/056287, filed Oct. 10, 2016, 3 pages.

*Primary Examiner* — Stephen M Johnson
(74) *Attorney, Agent, or Firm* — Christensen O'Connor Johnson Kindness PLLC

(57) ABSTRACT

Systems for universally locking a trigger of a firearm are provided that require authentication to transition the firearm to an unlocked state. In general, examples of the systems for universally locking a trigger of a firearm described herein are located in an interchangeable grip portion of the firearm or mounted to an accessory rail of the firearm. Embodiments of the system generally include trigger interference or blocking members to prevent actuation of the trigger until the authentication system has authorized the user to fire the firearm. Once the system is authenticated, embodiments of the system remain in an unlocked state while the user is grasping the firearm. When the user removes their hand from the firearm, embodiments of the trigger locking system automatically returns to a locked state, reducing or eliminating unauthorized use of the firearm.

28 Claims, 8 Drawing Sheets

(56) References Cited

U.S. PATENT DOCUMENTS

| | | | |
|---|---|---|---|
| 2013/0019510 | A1 | 1/2013 | Kemmerer et al. |
| 2014/0366419 | A1 | 12/2014 | Allan |

* cited by examiner

UNIVERSAL TRIGGER LOCKING SYSTEM

CROSS-REFERENCE TO RELATED APPLICATION

This application claims the benefit of U.S. Provisional Patent Application No. 62/267,530, filed Dec. 15, 2015, the disclosure of which is hereby expressly incorporated by reference herein in its entirety.

BACKGROUND

Controlling unauthorized use of a firearm is a focus of various manufacturers of weapons and weapon accessories. Gun safes and various locks used on the firing system of the firearm, along with other safety devices, can prevent injury by accidental discharge or intended use by a person the owner of the firearm does not authorize. Systems of the type restricting use of the firearm can be manual, often comprising basic integrated safeties or trigger locks; or automatic, often consisting of a mixture of electronic and mechanical components. Some systems act on the firearm components which impact the primer of a cartridge containing a projectile, such as a hammer or firing pin locking system, causing ignition of the gunpowder therein. Other systems prevent the actuation of the trigger of the firearm, thereby disabling the use.

In the systems which prevent actuation of the trigger, a lock is mounted on the trigger guard or integrated into the firing mechanism and removes the primary function of the trigger, rendering the firearm disabled. Design considerations dictate whether the trigger is physically blocked from movement, or merely removed from the actuation circuit such that actuation of the trigger does not begin a firing sequence in the firearm. User authentication provides an extra level of safety to the system, giving the owner of the firearm more control over access.

Conventional trigger locking systems and "smart" firearms typically require complex integration into the firearm. As a result, the firearm is often purchased with the system installed by the manufacturer. Integration by the manufacturer can provide the most seamless integration; however, manufacturer integration is not always practical for firearms which are already possessed by the owner, or firearms that were originally designed and manufactured without a locking system. Likewise, available aftermarket systems can be cumbersome, unreliable, and difficult to install by a firearm owner or retailer.

Therefore, a need exists for a trigger locking system that can be readily installed on a variety of firearms, integrates into the firearm without detracting from the form or function of the firearm, and includes a mechanism that both reliably locks the device and enables quick and repeatable access to actuation of the trigger upon proper authentication. Embodiments of the present disclosure are directed to fulfilling these and other needs.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a firearm trigger locking system is provided. The firearm trigger locking system generally includes a grip portion couplable to a firearm having a trigger and an authentication system operatively associated with the grip portion. The authentication system generally includes a central processing unit, a storage device in communication with the central processing unit, the storage device capable of storing an authorization key, an identification component in communication with the central processing unit, the identification component capable of recognizing the authorization key, an actuator in communication with the central processing unit, the actuator activatable by the central processing unit when the identification component recognizes the authorization key, and a battery in communication with the central processing unit. The firearm trigger locking system generally further includes a trigger interference member moveable within a slot, and a block moveable by the actuator from a first position to a second position when the identification component recognizes the authorization key, wherein the block may abut the trigger interference member in the first position to prevent movement of the trigger interference member within the slot for preventing actuation of the trigger.

In accordance with another embodiment of the present disclosure, a firearm grip assembly with an automated authenticating trigger locking feature is provided. The firearm grip assembly generally includes a handle couplable to a firearm, the handle including a firearm interface portion, and an authentication system disposed within the handle that is capable of transitioning a trigger of the firearm from a locked state to an unlocked state. The authentication system generally includes a central processing unit, a battery in communication with the central processing unit, the battery configured to be selectively isolated from the central processing unit by a switch an identification component in communication with the central processing unit, the identification component capable of selectively authenticating a user, and an actuator in communication with the central processing unit, the actuator activatable by the central processing unit when the identification component authenticates the user to transition the trigger of the firearm from the locked state to the unlocked state. The firearm grip assembly generally further includes a continuous firing button disposed within the handle and movable from a first position to a second position, wherein the continuous firing button may be configured to activate the switch upon movement from the first position to the second position, maintain the trigger of the firearm in the unlocked state in the second position, and transition the trigger of the firearm from the unlocked state to the locked state upon movement from the second position to the first position.

In accordance with any of the embodiments described herein, the firearm trigger locking system may further include a continuous firing button configured to maintain the block in the second position while the continuous firing button remains depressed.

In accordance with any of the embodiments described herein, the block may be moveable from the second position back into the first position when the identification component fails to recognize the authorization key to prevent movement of the trigger interference member within the slot for preventing actuation of the trigger.

In accordance with any of the embodiments described herein, the firearm trigger locking system may further include a cover portion removably coupled to the grip portion, wherein the cover portion may prevent access to internal components of the grip portion.

In accordance with any of the embodiments described herein, the cover portion may prevent unauthorized removal of the firearm trigger locking system from the firearm.

In accordance with any of the embodiments described herein, the firearm trigger locking system may further include a manual override apparatus for the authentication system.

In accordance with any of the embodiments described herein, the manual override apparatus may be selected from the group consisting of a combination lock, a dial lock, a keyed lock, and a security bit tool fastener.

In accordance with any of the embodiments described herein, the identification component may be selected from the group consisting of a radio frequency identification sensor, a fingerprint scanner, a heartbeat signature recognition sensor, and a retina scan identification sensor.

In accordance with any of the embodiments described herein, the selective authentication of the firearm using radio frequency identification may include a separate component external to the firearm trigger locking system embedded with the authorization key.

In accordance with any of the embodiments described herein, the grip portion may be configured to interface a grip mounting area of the firearm.

In accordance with any of the embodiments described herein, the grip mounting area may be a universal mounting area of an Assault Rifle platform firearm.

In accordance with any of the embodiments described herein, the firearm trigger locking system may further include a status indicator configured to provide a visible system status to the user.

In accordance with any of the embodiments described herein, the status indicator may provide the visible system status of one or more of locked, unlocked, charging of the battery, RFID authentication, enrollment mode status, manual lock override, system fault, low battery warning, and unauthorized movement of the firearm.

In accordance with any of the embodiments described herein, the firearm trigger locking system may further include a global positioning satellite (GPS) system configured to provide location information of the firearm.

In accordance with any of the embodiments described herein, the firearm trigger locking system may further include an accelerometer system configured to detect an unauthorized movement of the firearm.

In accordance with any of the embodiments described herein, the firearm grip assembly may further include a trigger interference member movable within a slot disposed in the firearm interface portion, the trigger interference member configured to abut the trigger of the firearm in the locked state to prevent actuation of the trigger.

In accordance with any of the embodiments described herein, the firearm grip assembly may further include a slidable block moveable by the actuator, wherein the slidable block may be configured to abut the trigger interference member to prevent movement of the trigger interference member in the locked state.

In accordance with any of the embodiments described herein, the firearm grip assembly may further include a cover portion removably coupled to the handle, wherein the cover portion may prevent access to internal components of the handle and unauthorized removal of the firearm grip assembly from the firearm.

In accordance with any of the embodiments described herein, the handle may be configured to interface a universal mounting area of the firearm.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

Figure 1:
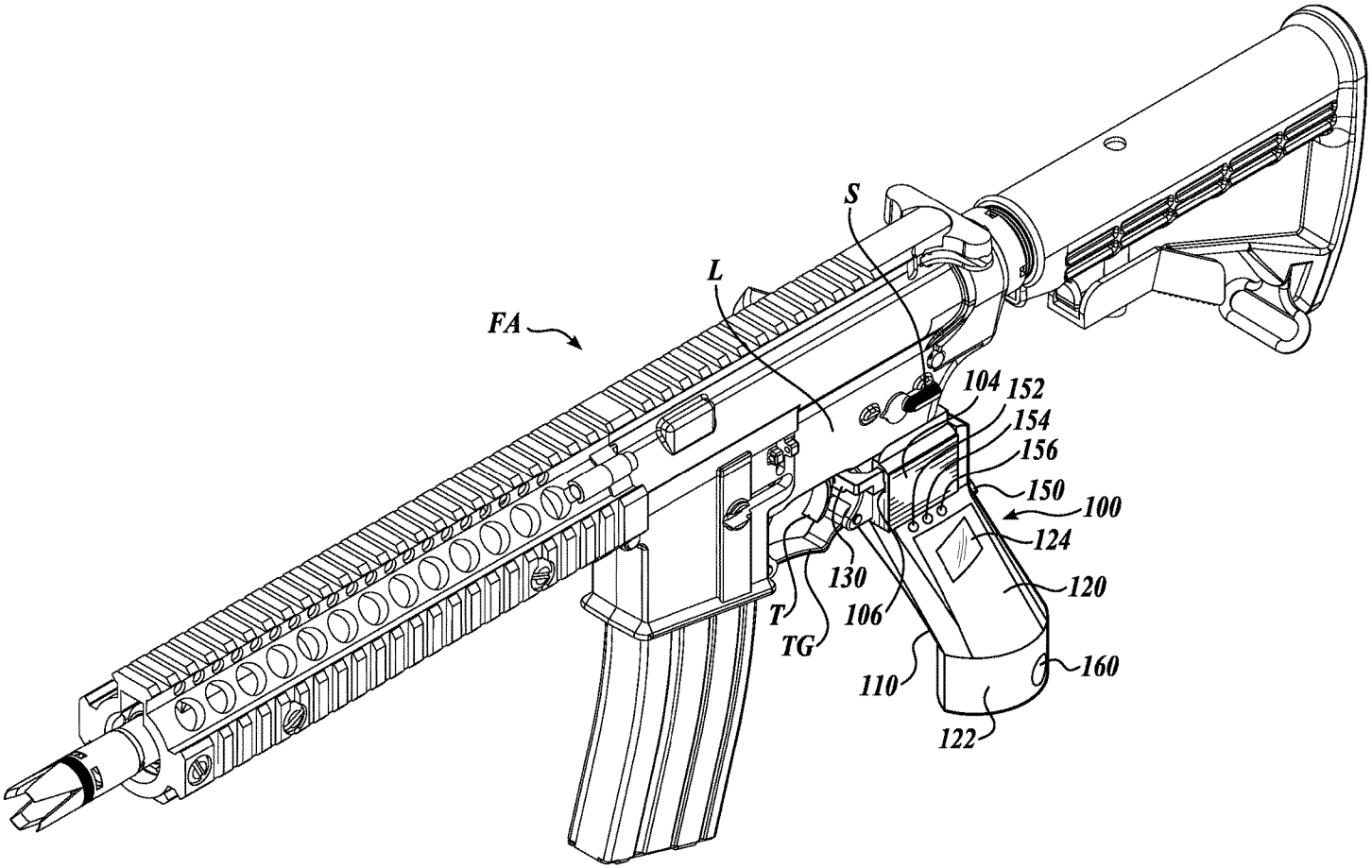
FIG. 1 is a top front left perspective view of a firearm with a universal trigger lock formed in accordance with one embodiment of the present disclosure, showing the universal trigger lock installed on the firearm.

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein are interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order to not unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "right hand," "left hand," "lateral," "medial," "in," "out," "extended," "advanced," "retracted," "proximal," "distal," "central," etc. These references, and other similar references in the present application, are only to assist in helping describe and understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value.

Embodiments of the present disclosure are generally directed to systems for preventing accidental and unauthorized discharge of a firearm. In general, examples of the systems herein are capable of use as an additional component to an existing firearm, with or without a manufacturer-installed safety system, or in conjunction with the new manufacture of a firearm. In this regard, embodiments of the present disclosure are generally capable of installation on a firearm with minimal training or experience of the user. Further, embodiments described herein are generally capable of removal from the firearm without permanently altering the function of the firearm. In addition, the embodiments described herein are generally capable of automated authentication of the firearm upon performing the proper comparisons with an authorization key as will be described in greater detail below. However, in certain embodiments, authentication is initiated by a manual action, such as the press of a button or the command of an initialization procedure. In this regard, embodiments include authentication methods which can be initiated automatically upon grasping the apparatus, or can require manual initiation.

Embodiments of the present disclosure are used to provide authentication of the user holding the firearm prior to allowing the trigger to actuate and fire the weapon. Although embodiments of the present disclosure are not directed to manual locking systems for firearms, the embodiments herein are capable of operation in conjunction with the integrated safety of the firearm, and as such, the FIGURES and description herein assume a safety S of the firearm is present in addition to the embodiments disclosed herein. In other embodiments, the embodiments disclosed herein are used on firearms without a manual safety S. In the illustrated embodiments of the FIGURES shown herein, the universal trigger locking system is shown attached to a firearm of an "Assault Rifle" type (e.g., an "AR-15," hereinafter "AR"); however, the embodiments described herein are intended for use with any suitable firearm to prevent accidental and unauthorized discharge.

In one aspect of the present disclosure, a firearm trigger locking system is provided. In one embodiment, the system includes: a grip portion couplable to a firearm having a trigger; an authentication system operatively associated with the grip portion, the authentication system includes: a central processing unit; a storage device in communication with the central processing unit, the storage device capable of storing an authorization key; an identification component in communication with the central processing unit, the identification component capable of recognizing the authorization key; an actuator in communication with the central processing unit, the actuator activatable by the central processing unit when the identification component recognizes the authorization key; and a battery in communication with the central processing unit; a trigger interference member moveable within a slot; and a block moveable by the actuator from a first position to a second position when the identification component recognizes the authorization key, wherein the block abuts the trigger interference member in the first position to prevent movement of the trigger interference member within the slot for preventing actuation of the trigger.

In another aspect of the present disclosure, a firearm grip assembly with an automated authenticating trigger locking feature is provided. In one embodiment, the firearm grip assembly includes: a handle couplable to a firearm, the handle including a firearm interface portion; an authentication system disposed within the handle that is capable of transitioning a trigger of the firearm from a locked state to an unlocked state, the authentication system includes: a central processing unit; a battery in communication with the central processing unit, the battery configured to be selectively isolated from the central processing unit by a switch an identification component in communication with the central processing unit, the identification component capable of selectively authenticating a user; and an actuator in communication with the central processing unit, the actuator activatable by the central processing unit when the identification component authenticates the user to transition the trigger of the firearm from the locked state to the unlocked state; a continuous firing button disposed within the handle and movable from a first position to a second position, wherein the continuous firing button may be configured to activate the switch upon movement from the first position to the second position, maintain the trigger of the firearm in the unlocked state in the second position, and transition the trigger of the firearm from the unlocked state to the locked state upon movement from the second position to the first position.

Figure 2:
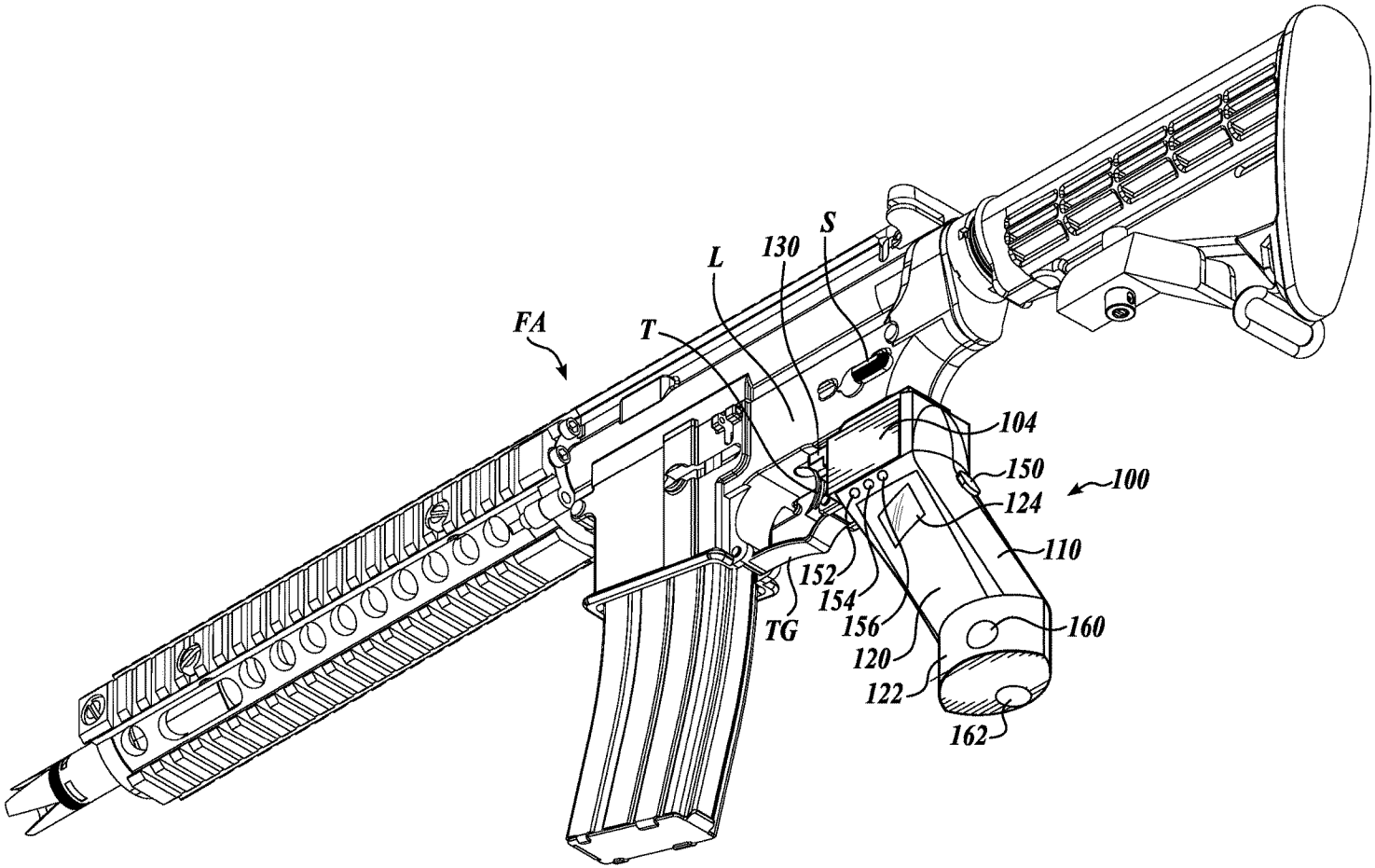
FIG. 2 is a bottom rear left perspective view of the firearm of FIG. 1.

A universal trigger locking system constructed in accordance with one embodiment of the present disclosure is provided. Referring to FIGS. 1 and 2, a trigger lock assembly 100 of a firearm FA generally includes a firearm interface portion 104 including a slot 106, the firearm interface portion 104 couplable to a lower assembly L of the firearm FA, a grip portion 110, a cover portion 120, a base portion 122, a fingerprint scanner 124, a trigger interference member 130 capable of blocking actuation of a trigger T contained within a trigger guard TG, a continuous fire button 150, a cover portion access lock 160, and a manual authentication component 162. The grip portion 110 also includes a red status light emitting diode (LED) 152, a green status LED 154, and a blue status LED 156. The trigger lock assembly 100 is configured to interface the hand of a user of the firearm FA (not pictured). In some embodiments, the trigger lock assembly 100 replaces the grip of the firearm FA as provided by the original equipment manufacturer (OEM). In other embodiments, the trigger lock assembly 100 components are integrated into the firearm FA and do not replace the grip.

As shown in FIG. 1, the firearm interface portion 104 provides a mounting link between the lower assembly L of the firearm FA and the grip portion 110. In the illustrated embodiment, the firearm interface portion 104 is shown as integral to the grip portion 110; however, in other embodiments, the firearm interface portion 104 is a separated component from the grip portion 110. In embodiments where the firearm interface portion 104 is separated, a single style of grip portion 110 may be specified in conjunction with numerous styles of firearm interface portions 104 such that the trigger lock assembly 100 is adaptable to interface different firearms (e.g., different styles and brands of rifles, shotguns, handguns, etc.) through the firearm interface feature 102. In this regard, a firearm interface feature 102 (see FIG. 3) adapts the firearm interface portion 104 to the contours of the firearm FA on which it is intended to mount. In embodiments where the firearm interface portion 104 is integral to the grip portion 110, the firearm interface feature 102 adapts the component of the firearm interface portion 104 and the grip portion 110 to the contours of the firearm FA on which it is intended to mount.

Figure 3:
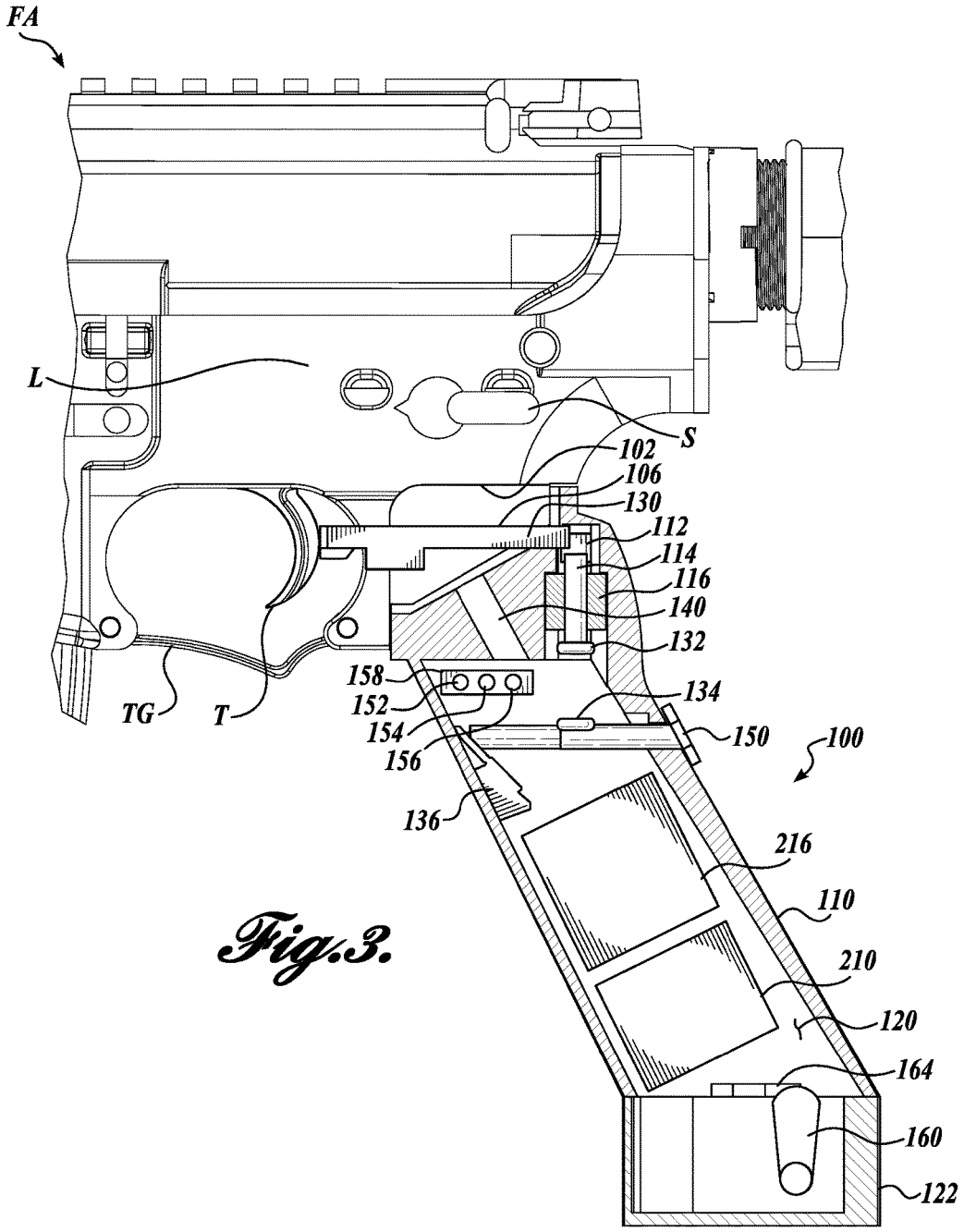
FIG. 3 is a left side detail view of the firearm of FIG. 1, showing a cutaway view of the universal trigger lock in the locked position, in accordance with the disclosed embodiments, with the continuous fire button depressed.

In some embodiments, the trigger lock assembly 100 mounts to the firearm FA using a fastener (not shown) inserted into a mounting bore 140 (see FIG. 3). In other embodiments, other mounting methods are suitably used to mount the trigger lock assembly 100 to the firearm FA. In this regard, access to remove the trigger lock assembly 100 from the firearm FA is restricted such that only a user with access to the cover portion 120 using the cover portion access lock 160 can remove the trigger lock assembly 100 from the firearm FA.

The grip portion 110 provides, among other features, a location for a user to position a hand, as well as housing and protection for the internal components of the of the trigger lock assembly 100, which are described in greater detail below. The grip portion 110 includes the cover portion 120 to give access to the internal components and release the mounting of the trigger lock assembly 100 from the firearm FA for removal. In the illustrated embodiment, the cover portion 120 is integral with the base portion 122 such that both components are removed in combination. In other embodiments, the cover portion 120 is separated from the base portion 122 such that the base portion is not removable from the grip portion 110. In further embodiments, the cover portion 120, the base portion 122, and the grip portion 110 are separate components. In some embodiments, the cover portion 120 is lockable to restrict access to the internal components and the mounting release, which would allow an unauthorized user to disable the universal trigger locking system. In the illustrated embodiment, the cover portion 120 includes a cover portion access lock 160 that prevents removal of the cover portion 120 without a key or other keyed tool (not shown). In other embodiments, a combination lock, dial lock, or a security bit tool fastener is used to allow removal of the cover portion 120. In further embodiments, the authentication system described below is utilized to allow removal of the cover portion 120 such that authenticating the firearm FA to fire also allows removal of the cover portion 120.

Figure 4:
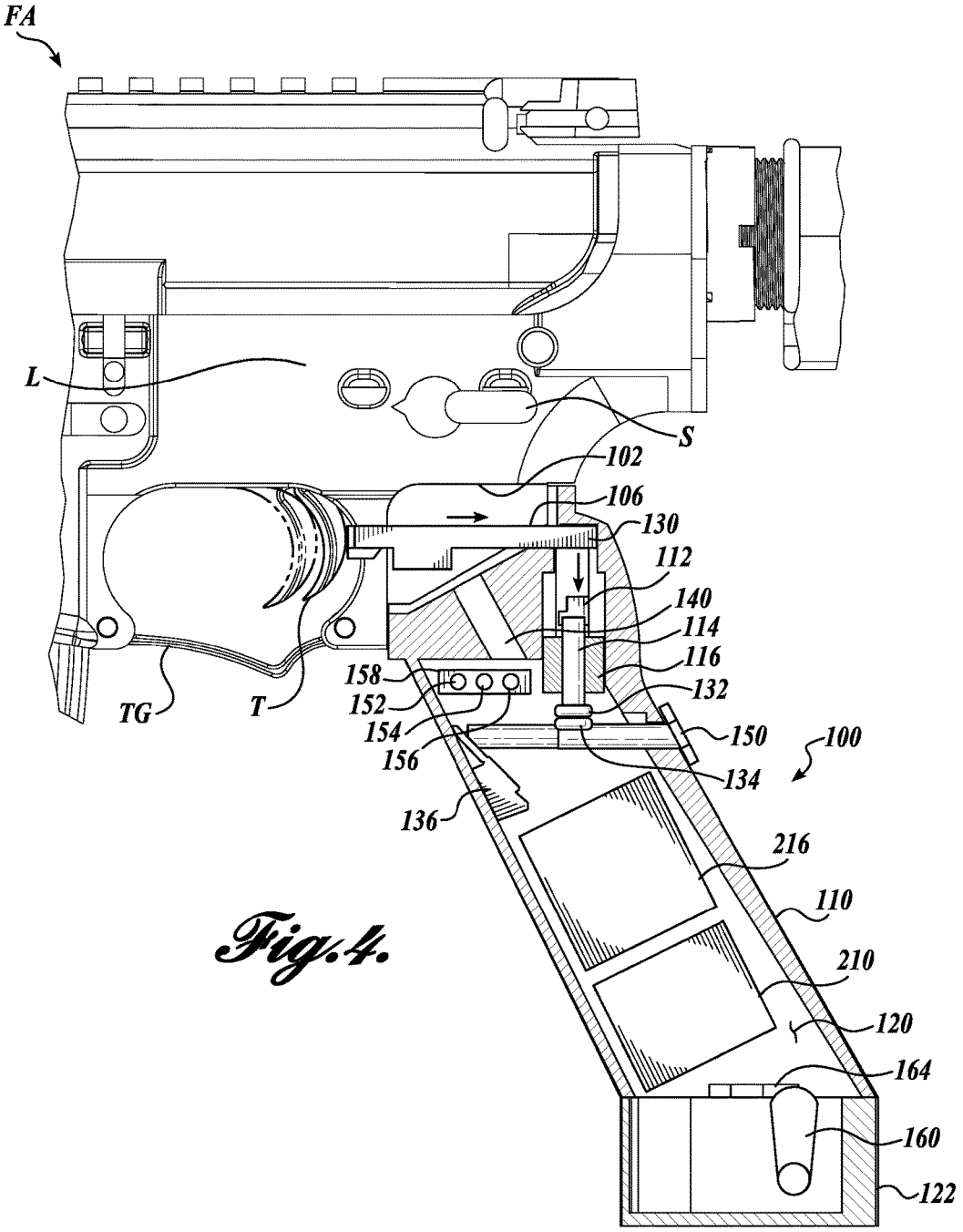
FIG. 4 is a left side detail view of the firearm of FIG. 1, showing a cutaway view of the universal trigger lock in the armed position, in accordance with the disclosed embodiments, with the locking mechanism retracted, the trigger actuated, and the continuous fire button depressed.
Figure 5:
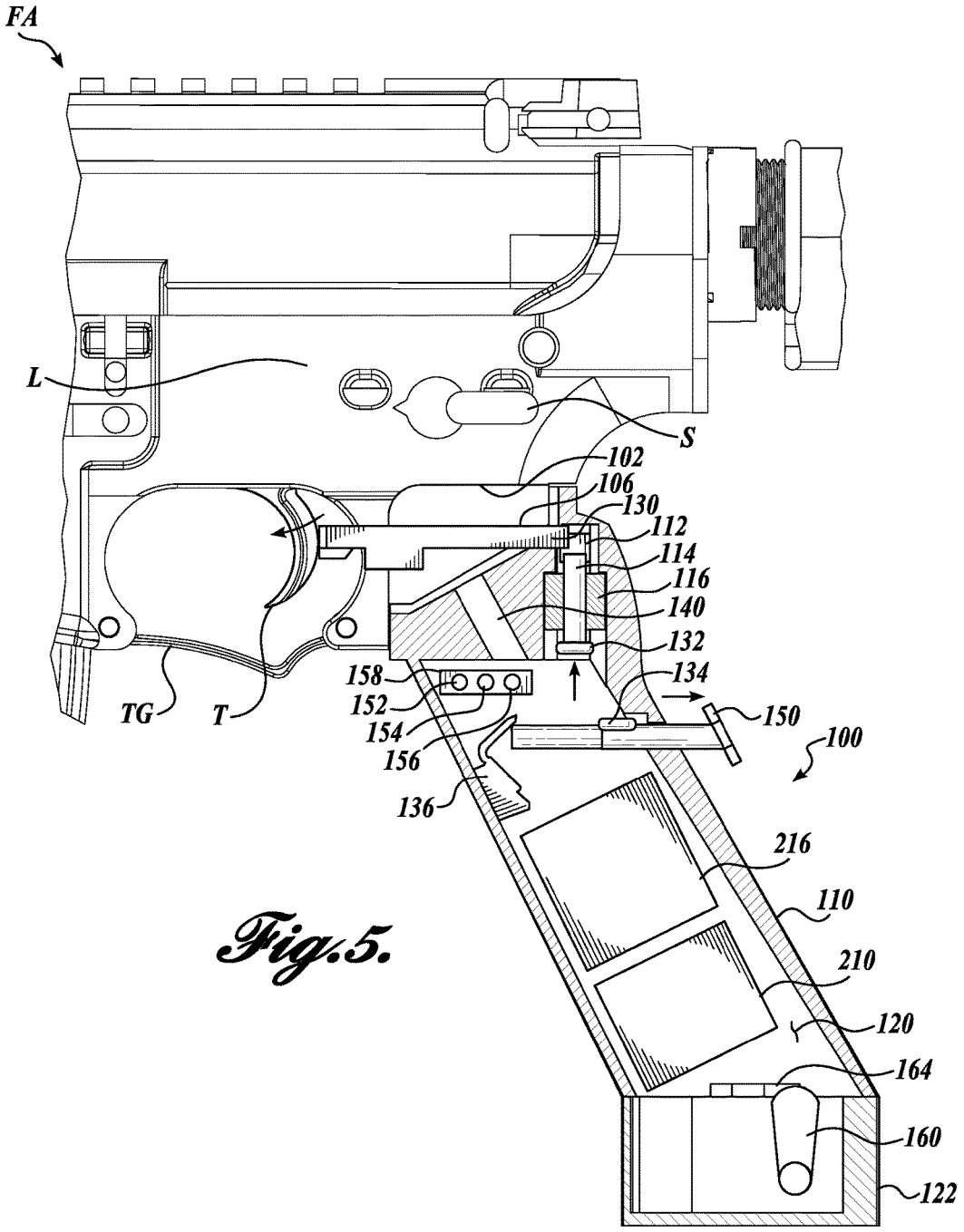
FIG. 5 is a left side detail view of the firearm of FIG. 1, showing a cutaway view of the universal trigger lock returned to the locked position, in accordance with the disclosed embodiments, with the continuous fire button extended to a resting position.
Figure 6:
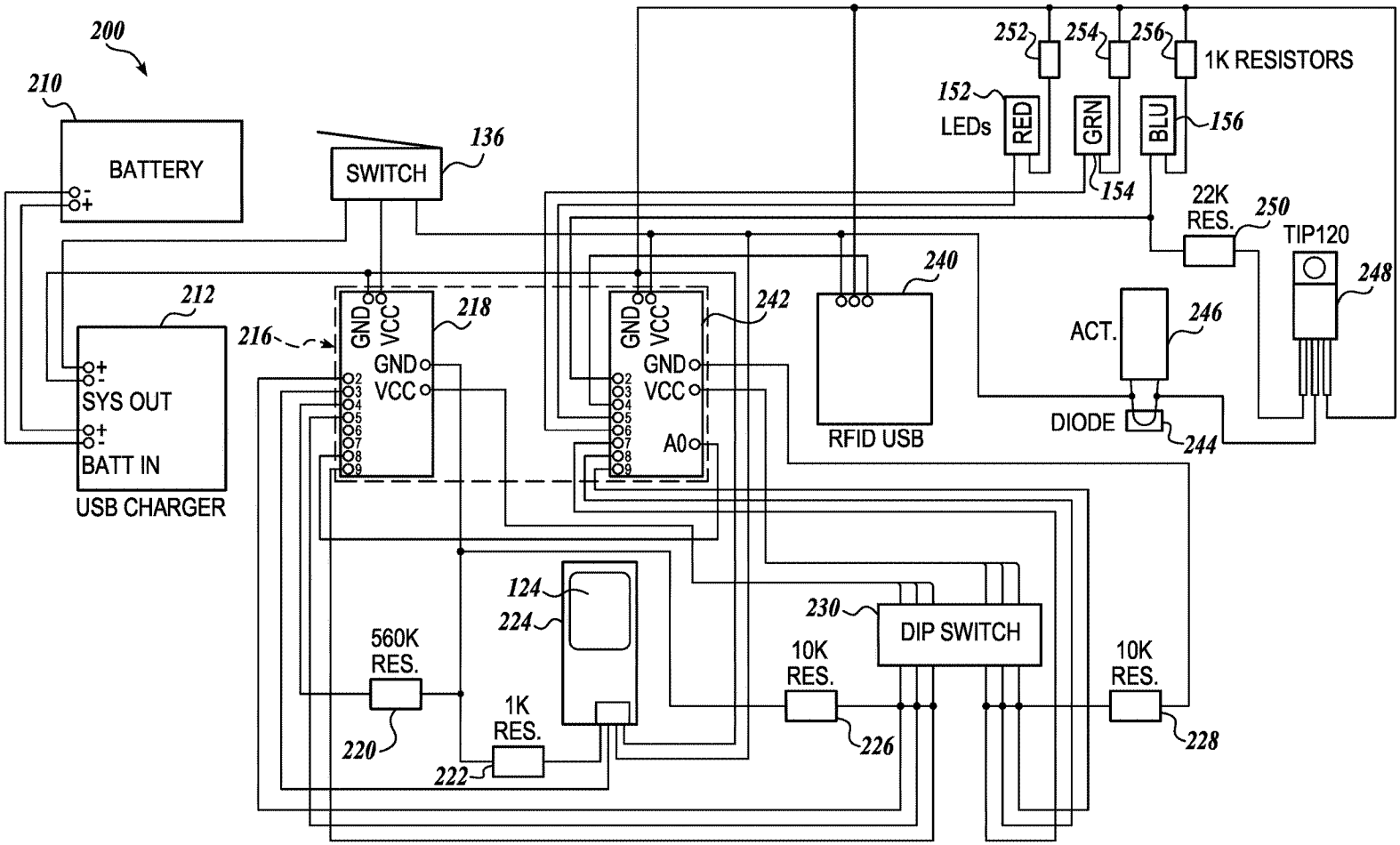
FIG. 6 is an electrical diagram of the universal trigger lock of FIG. 1, showing representative electrical connections.

Now turning to FIGS. 3-5, detailed views of the trigger lock assembly 100 transitioning through various functional states are shown in cutaway. For simplification and clarity, wiring connections between the components depicted in FIGS. 3-5 have been omitted. Representative wiring of the components is shown in FIG. 6; however, the wiring diagram of FIG. 6 should not be construed as limiting the wiring layout of the universal trigger lock system of the present disclosure. The trigger lock assembly 100 is shown with the cover portion 120, the fingerprint scanner 124, and a fingerprint scanner printed circuit board (PCB) 224 (see FIG. 6) removed, and a cutaway through the approximate midsection of the firearm interface portion 104, the grip portion 110, and the base portion 122 to show further aspects of the embodiments of the present disclosure.

The grip portion 110 includes a cutout or hollow area where various components of the trigger lock assembly 100 are assembled. The various components inside of the grip portion 110 are components of the electronic system 200, which include a battery 210, a main PCB 216 with at least one central processing unit (CPU, not shown), a manual lock 164 for manual override of the authentication system, a continuous fire button switch 136, a status LED mounting board 158, a trigger interference member block 112, a block plunger 114, a plunger sleeve 116, a plunger magnet 132, a continuous fire magnet 134, and the mounting bore 140 for coupling of the trigger lock assembly 100 to the lower assembly L of the firearm FA.

Referring briefly to FIG. 6, various components also assembled in the grip portion 110, but not shown in FIGS. 3-5, generally include the fingerprint scanner PCB 224, an electronic actuator 246, a radio frequency identification system (RFID) universal serial bus (USB) board 240, a USB charger 212, a continuous fire button switch 136, resistors 220, 222, 226, 228, 250, 252, 254, and 256, a dip switch 230, a global positioning satellite (GPS) PCB 218, a secondary PCB 242, a diode 244, and a transistor 248. Although the various components described above are not shown in FIGS. 3-5, the components may be mounted in the grip portion 110 in any suitable location, including in a laminate orientation with other flat components.

The layout shown in FIG. 6 is intended to provide one representative example of the communication layout between components, as included in one embodiment of the present disclosure. In this regard, the embodiments disclosed herein, when a component is in communication with another component, the communication includes both wired and wireless types, and any other suitable technology not known or later developed. In some embodiments, the components and layout shown in FIG. 6 are altered to adapt to different brands and models of the components, or other specified features of the universal trigger lock system. For example, if a fingerprint scanner using a technology other than RFID is used, the RFID USB board 240 and associated components and wiring may be omitted unless required by another RFID-based system. In some embodiments, a radio-frequency (RF) type fingerprint scanner is included in the universal trigger lock 100 for authentication of the system. However, in other embodiments, fingerprint scanners utilizing technology of complementary metal-oxide semiconductor (CMOS) and capacitive discharge are suitably used. In further embodiments, a purchaser of the universal trigger lock system may specify certain features in conjunction with the purchase of the trigger lock assembly 100. In this regard, components are omitted or added to align with the purchaser's specifications such that costs of components are omitted or included when a lower or higher-content product is specified.

Now turning back to FIGS. 3-5, an authentication and unlock sequence of the trigger lock assembly 100 is shown in the transition from FIGS. 3 to 4. A return to locked state sequence following authentication of the trigger lock assembly 100 is shown in the transition from FIGS. 4 to 5. The trigger lock assembly 100 is configured for installation on a firearm FA using the firearm interface portion 104, such that the trigger lock assembly 100 interfaces the trigger T through the trigger interference member 130 slidably positioned in the slot 106. In this respect, FIG. 3 shows the trigger T in an unactuated position which would normally be ready-to-fire; however, the trigger T is prevented from travelling toward the firearm interface portion 104 (thereby actuating the firing system of the firearm FA) by direct interference from the trigger interference member 130 within the trigger guard TG. To allow firing of the firearm FA, the trigger interference member 130 must be allowed to slide within the slot 106 in the firearm interface portion 104 toward the rear of the firearm FA, allowing the actuation of the trigger T. As shown in FIG. 3, the sliding motion of the trigger interference member 130 in the slot 106 is prevented by the trigger interference member block 112.

The process of authentication, thereby arming the firearm FA, will now be described in greater detail. Upon grasping the grip portion 110 of the trigger lock assembly 100, the user compresses the continuous fire button 150 with a palm of the user's hand, as shown in a compressed state in FIG. 3, with a corresponding interface and movement of the continuous fire button switch 136. In some embodiments, the continuous fire button 150 includes a self-return feature (e.g., a spring (not shown)) to ensure the continuous fire button 150 is returned to an extended position following the removal of the hand of the user, preventing further actuation of the firing system of the firearm FA without authentication.

With the continuous fire button 150 compressed, the plunger magnet 132 and the continuous fire magnet 134 are aligned with the path of the block plunger 114. In some embodiments, the depression of the continuous fire button 150 and the interaction with the continuous fire button switch 136 sends a signal to the electronic system of the trigger lock assembly 100 such that it "wakes" from a state of low power consumption. In this regard, the battery 210 can retain a charge for longer periods of time and remain ready for use when the firearm FA is stored unattended. In these embodiments, the signal from the continuous fire button 150 activates the fingerprint scanner 124 such that it is ready to read the fingerprint of a user to commence the authentication process. In other embodiments, a separate switch accessed on the exterior of the trigger lock assembly 100 is used to activate and wake the system. In further embodiments, non-mechanical methods are used to activate the system from the low power consumption state, such as RFID, capacitive discharge, accelerometer signals, etc.

As the user wraps fingers around the grip portion 110, the middle finger aligns with the fingerprint scanner 124, which performs a scan of the user's fingerprint and sends the scan to the main PCB 216 for analysis. The main PCB 216 compares the scan with a stored authorized user fingerprint, i.e., the authorization key. To accomplish the authentication, the main PCB 216 suitably includes a form of computer memory to store the information. In some embodiments, multiple authorized fingerprints are included in a single trigger lock assembly 100 such that, for example, all members of a household can authenticate and arm the firearm FA. In other embodiments, only a single fingerprint is stored for access to the firearm FA. Still, in further embodiments, any finger of the user is used to authenticate the system. Upon valid authentication, the main PCB 216 sends a signal through the diode 244 to the electronic actuator 246 drivingly connected to the block plunger 114. The retraction of the electronic actuator 246 moves the block plunger 114, and thereby the trigger interference member block 112 out of the path of the trigger interference member 130 such that the trigger T can be actuated.

When the block plunger 114 is moved by the electronic actuator 246, the plunger magnet 132 and the continuous fire magnet 134 are in close proximity such that magnetic force holds the block plunger 114 in an armed position (see FIG. 4). The block plunger 114 includes a self-return feature, e.g., a plunger spring (not shown), that returns the block plunger 114 and the trigger interference member block 112 to the locked position (away from the continuous fire magnet 134, as shown in FIG. 4). The plunger spring is not strong enough to overcome the magnetic force between magnets 132 and 134, but has the requisite force to return the block plunger 114 and the trigger interference member block 112 to the locked position when the continuous fire button 150 is released, removing the magnetic bond between magnets 132 and 134 by increasing the distance therebetween. In some embodiments, when the magnets 132 and 134 are providing a magnetic bond, power to the electronic actuator 246 is removed, allowing the electronic actuator 246 to return to a non-energized state, thereby conserving energy in the battery 210. In other embodiments, the magnets 132 and 134 are omitted and replaced with mechanical retention, electrical retention, or a continuous signal to the electronic actuator 246.

As shown most clearly by the arrows in FIG. 4, once the trigger interference member block 112 has been retracted by the block plunger 114, the trigger interference member 130 no longer prevents actuation of the trigger T. The trigger T is shown in an actuated state in FIG. 4, with the trigger interference member 130 moving rearward within the firearm interface portion 104. In the illustrated embodiments, as described, the firearm FA can be fired without interruption so long as the continuous fire button 150 is depressed, keeping the magnetic bond between the plunger magnet 132 and the continuous fire magnet 134. However, in other embodiments, the trigger lock assembly 100 must be continuously authenticated to allow further firing of the firearm FA.

Like the block plunger 114, in some embodiments, the trigger interference member 130 includes a self-return feature, e.g., a trigger interference member spring (not shown), to return the trigger interference member 130 to a lockable state such that the trigger interference member block 112 can travel behind the trigger interference member 130 to prevent actuation of the trigger T, returning the trigger lock assembly 100 to a locked state. In this regard, when actuating the trigger T, the trigger interference member 130 retains contact with the trigger T throughout the actuation, closely following the motion of the trigger T. In other embodiments, the trigger interference member 130 remains retracted while the system is authenticated so that the trigger interference member 130 does not interfere with the trigger T movement, which can adversely affect the feel of the trigger as perceived by the user.

As shown most clearly by the arrows in FIG. 5, various components move to return the trigger lock assembly 100 to a locked position. As the trigger T is released, the trigger interference member 130 follows the trigger T forward to a lockable position with the assistance of the self-return feature. Next, the continuous fire button 150 is returned to a released state, indicative of the user removing the hand from the grip portion 110. As the continuous fire button 150 is released, the movement of the plunger magnet 132 and the continuous fire magnet 134 break the magnetic bond, allowing the self-return feature of the block plunger 114 to return the trigger interference member block 112 to the locked position behind the trigger interference member 130, thereby preventing further actuation of the trigger T until authentication is processed further.

As described above, in embodiments of the present disclosure, the firearm interface feature 102 of the firearm interface member 104 is configured to interface different configurations of firearm. In some embodiments, such as those illustrated herein, the trigger lock assembly 100 is manufactured with a firearm interface feature 102 that corresponds closely and mates with a grip mounting area of an AR platform firearm. In other embodiments, the trigger lock assembly 100 is manufactured with a firearm interface feature 102 that mates with a grip mounting area of other standard platform firearms, such as rifles, shotguns, handguns, and the like. In this regard, different shapes of the firearm interface feature 102 are suitably required and are within the scope of the present disclosure. In some embodiments relating to different firearm installations, other features of the trigger lock assembly 100 are changed to conform to the interface of the firearm.

When the firearm FA is locked using the trigger lock assembly 100 of the present disclosure (see, e.g., FIG. 3), the user must authenticate the system with a proper authorization key before the trigger interference member block 112 will retract and allow actuation of the trigger T of the firearm FA. In one embodiment, authentication is performed using an RFID USB board 240 paired with an RFID reader in the trigger lock assembly 100. The RFID system suitably includes a wearable component (not shown) as the authorization key carrying device, such as a ring, bracelet, glove, necklace, etc., or a non-wearable component, such as a card, remote, key fob, etc. The system authenticates the RFID device through the RFID USB board 240 to authorize the user and retracts the trigger interference member block 112 using the electronic actuator 246. In other embodiments described above, authentication is performed using a fingerprint scanner 124 mounted in the fingerprint scanner PCB 224 integrated into a window of the cover portion 120. In further embodiments, authentication is performed using heartbeat signature recognition, retina scan identification, or other suitable authentication methods. A valid authentication requires enrollment of the authorization key (e.g., a fingerprint image, RFID key, heartbeat signature, retina scan, etc.). The enrollment process for new authorization keys, or to replace existing authorization keys, is described in further detail related to "enrollment mode" below.

In further embodiments of the present disclosure, the RFID and fingerprint authentication methods are both utilized in conjunction within a single trigger lock assembly 100. In this regard, the RFID is the first or primary authentication method due to the speed at which the RFID device can be identified (without the user touching the trigger lock assembly 100). The fingerprint authentication is then used as a secondary or backup authentication system. If the user does not have the RFID device near the RFID reader, the firearm FA can still be armed and used by the authorized user. A final authentication method is manual using either a keyed or combination lock as shown by the manual authentication component 162. The user inserts a key or enters a combination in the manual authentication component 162 to authenticate the system and arm the firearm FA. In this regard, if the battery 210 lacks the requisite power to operate the electronic actuator 246, or any other electronic component of the trigger lock assembly 100, the manual authentication component 162 overrides the lock and renders the firearm FA functional for firing. In other embodiments, any combination and order of authentication methods are suitably used with the trigger lock assembly 100.

Turning now to FIG. 6, details of the electronic system 200 of the trigger lock assembly 100 will be explained in further detail. The battery 210 provides system electrical power to the various components. The battery 210 is charged using the USB charger 212 which includes a charging port (not shown), e.g., a mini or micro USB female plug, a wireless charger, etc. The continuous fire button switch 136 is depressed by the continuous fire button 150 such that the system is energized by the user grasping the grip portion 110. As previously stated, the electronic system 200 power is conserved until receiving a "wake" signal such that the firearm FA can be left unattended for extended periods of time without charging the battery 210.

The main PCB 216, including the GPS PCB 218 and the secondary PCB 242, performs a majority of the computing tasks related to the function of the electronic system 200. In this regard, a CPU may perform processes to activate different features of the electronic system 200. The main PCB 216 is centrally in communication with to the various components of the electronic system 200 through various resistors 220, 222, 226, 228, 250, 252, 254, and 256 of different resistance levels. In this regard, although representative resistance levels are listed in FIG. 6 (1K, 10K, 22K, etc.), any suitable resistance level may be used in the electronic system 200 to achieve the intended function. Although the main PCB 216 is shown as comprising multiple PCB units 218 and 242, in some embodiments, the main PCB 216 comprises a single PCB unit. In other embodiments, more than two PCB units comprise the main PCB 216. In this regard, features of the trigger lock assembly 100 may be added or omitted per model or upon the purchaser's request.

The dip switch 230 provides increased flexibility for the functionality of the electronic system 200 such that different components and options are available for adjustment by the manufacturer and/or user. In one embodiment, the dip switch 230 allows the manufacturer and/or user to place the main PCB 216 into enrollment mode. In this regard, enrollment mode allows the authentication system to "learn" a new authorization key for the authentication process, e.g., a fingerprint, RFID signal from the wearable component, heartbeat signature, retina key, etc. In one example, enrollment mode is used by a new purchaser of the universal trigger lock 100. In another example, enrollment mode is used to transfer authorization to another person or to authorize an additional or different wearable component for use with the firearm FA.

In one embodiment, the GPS PCB 218 integrates a positioning functionality to the system of the present disclosure. In one example, the GPS PCB 218 is programmed such that the electronics system 200 sends a signal that can be tracked using a satellite tracking system. This signal can be used to aid in recovery of stolen or misplaced firearms. In particular, law enforcement is a likely candidate for the described GPS functionality. In another aspect, the GPS PCB 218 may include accelerometers that alert the user if the firearm FA is disturbed by an unauthorized user. In these embodiments, the electronics system 200 includes a transmitting device (not shown), such as a wireless transmitter, RFID transmitter, or an SMS transmitter, among others, to send a signal that can be remotely received by a device.

The status LED mounting board 158 (see FIG. 3) includes the red status LED 152, the green status LED 154, and the blue status LED 156, which provide the user an indication of different stages of the electronic system 200. In one representative embodiment, the red status LED 152 indicates the battery 210 of the trigger lock assembly 100 is charging, the green status LED 154 indicates the trigger lock assembly 100 has successfully completed the enrollment of a new authorization key, and the blue status LED 156 indicates the trigger lock assembly 100 is authenticated and the firearm FA is ready to fire. In other embodiments, the LEDs 152, 154, and 156 indicate any information or state of the electronic system 200, including RFID authentication, enrollment mode status, manual lock override, system fault, low battery warning, unauthorized movement, etc. In this regard, a single LED may be active at any given time, or multiple LEDs may be active simultaneously. Further, any single LED may signify several features by using a mixture of steady on, blinking frequency, or other on-off patterns to indicate information of the type described above. For example, the red status LED 152 may simultaneously display information related to the charging status of the battery 210 and a failure in enrollment of a new authorization key by switching from steady on to blinking of the red status LED 152.

Now referring to FIGS. 7-10, trigger lock assemblies in accordance with other embodiments of the present disclosure will be described in more detail. The trigger lock assemblies are substantially similar in materials and operation as the previously described embodiment, except for differences regarding the locking of the trigger and the firearm interface portion (FIGS. 7 and 8) and the mounting configuration of the trigger lock assembly (FIGS. 9 and 10), which will be described in greater detail below. For clarity in the ensuing descriptions, numeral references of like elements of the trigger lock assembly 100 are similar, but are in the 200 series for the illustrated embodiment of FIGS. 7 and 8, and in the 300 series for the illustrated embodiment of FIGS. 9 and 10.

Figure 7:
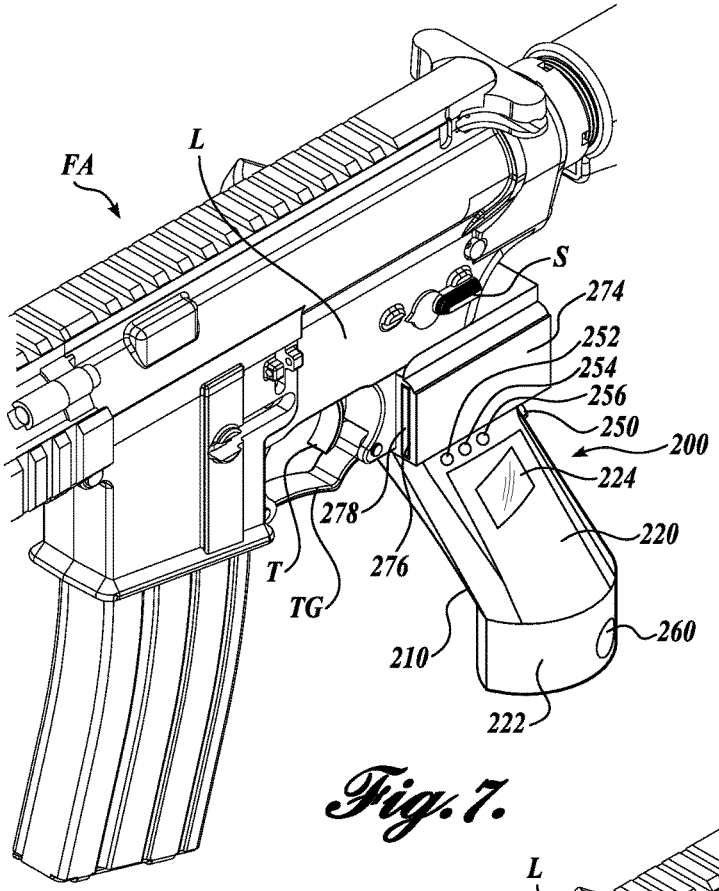
FIG. 7 is a top front left perspective view of a firearm with a universal trigger lock formed in accordance with another embodiment of the present disclosure, showing the universal trigger lock in the unlocked position.
Figure 8:
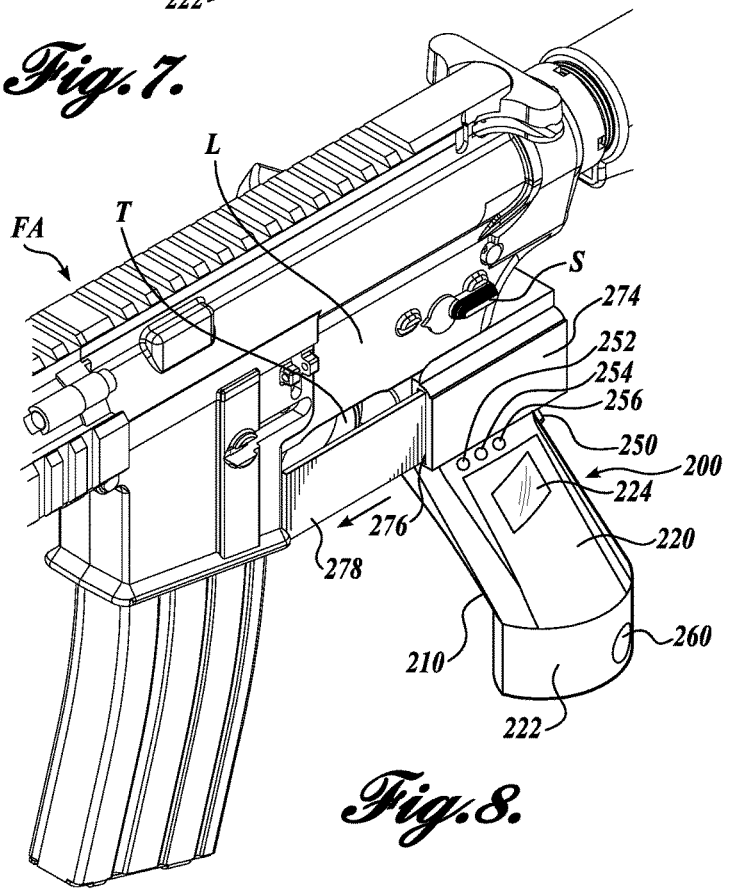
FIG. 8 is a top front left perspective view of the firearm of FIG. 7, showing the universal trigger lock in the locked position in, in accordance with the disclosed embodiments.

In the illustrated embodiments of FIGS. 7 and 8, a trigger lock assembly 200 generally includes a firearm interface portion 274 including a vertical slot 276, the firearm interface portion 274 couplable to a lower assembly L of the firearm FA, a grip portion 210, a cover portion 220, a base portion 222, a fingerprint scanner 224, a trigger door member 278 capable of blocking access to the trigger T contained within the trigger guard TG, a continuous fire button 250, a cover portion access lock 260, and a manual authentication component 262. The grip portion 210 also includes a red status LED 252, a green status LED 254, and a blue status LED 256. The trigger lock assembly 200 is configured to interface the hand of a user (not pictured) of the firearm FA. Although only the FIGS. 7 and 8 only show the left side of the trigger lock assembly 200, the right side is substantially mirrored with a second vertical slot 276 and a second trigger door member 278 slidable within the firearm interface portion 274.

As shown in the transition from FIG. 7 (unlocked) to FIG. 8 (locked), the access to the trigger T is blocked by the trigger door members 278 on either side of the trigger guard TG, such that a user cannot reach and actuate the trigger T until the trigger door members 278 retract within the vertical slots 276 of the firearm interface portion 274. In some embodiments, to allow for retraction of the trigger door members 278, the firearm interface portion 274 is extended toward the rear of the firearm FA. In some embodiments in contrast to the embodiment of FIGS. 1-5, the actuation of the trigger T is not positively blocked from movement by components the trigger lock assembly 200 (such as with the trigger interference member 130), the access to the trigger T is restricted. In other embodiments, a combination of restricted access and positive blocking of the trigger is suitably used.

Figure 9:
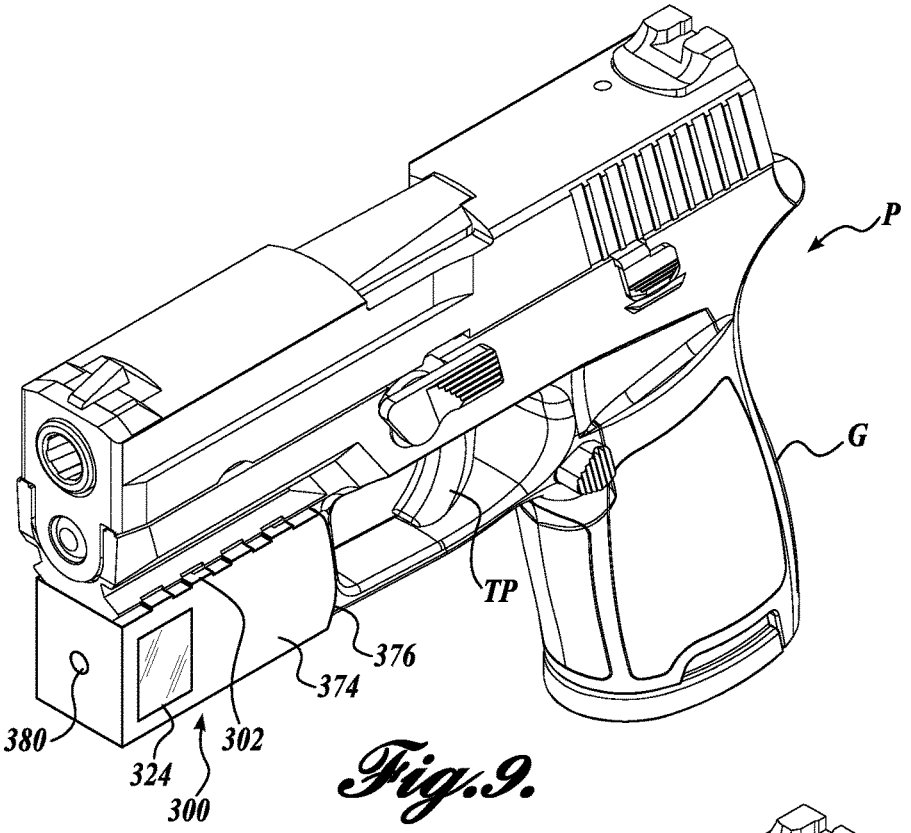
FIG. 9 is a top front left perspective view of a pistol with a universal trigger lock formed in accordance with another embodiment of the present disclosure, showing the universal trigger lock in the unlocked position.
Figure 10:
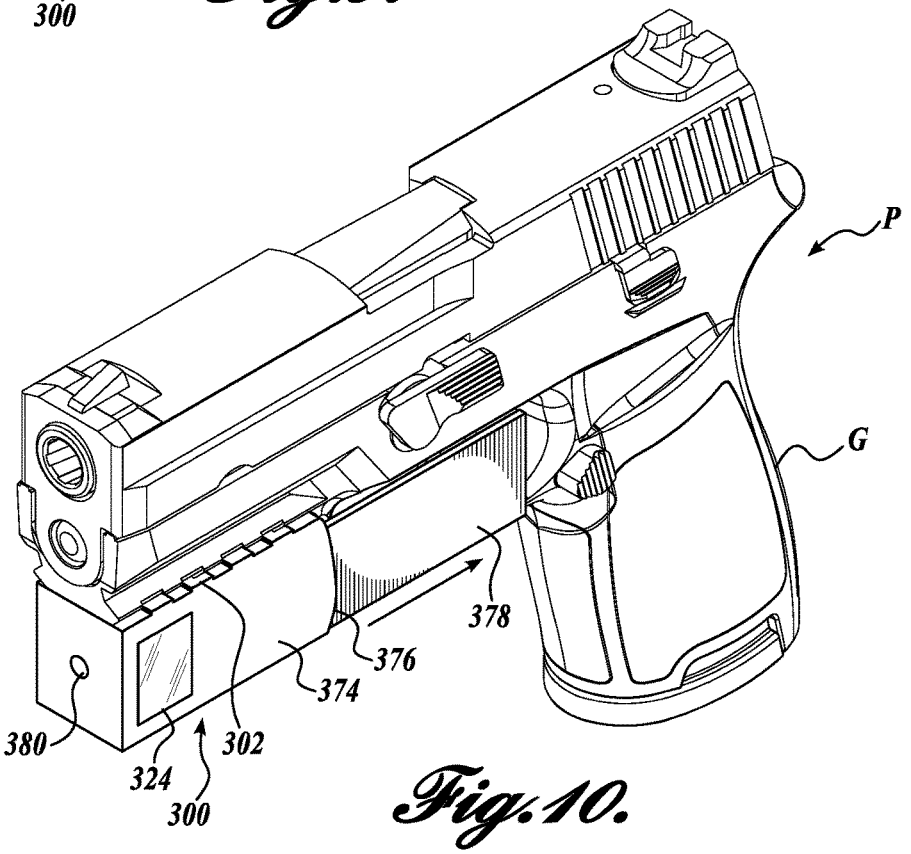
FIG. 10 is a top front left perspective view of the pistol of FIG. 9, showing the universal trigger lock in the locked position in, in accordance with the disclosed embodiments.

In the illustrated embodiments of FIGS. 9 and 10, a trigger lock assembly 300 is shown attached to an accessory rail portion of a pistol P having a pistol trigger TP and a grip G. The accessory rail portion traditionally provides a mounting location for certain pistol accessories like a flashlight, laser, or other attachable accessory. The trigger lock assembly 300 generally includes a pistol interface feature 302, a pistol interface portion 374, a vertical slot 376 in the pistol interface portion 374, a fingerprint scanner 324, and a trigger door member 378. Although only the FIGS. 9 and 10 only show the left side of the trigger lock assembly 300, the right side is substantially mirrored with a second vertical slot 376 and a second trigger door member 378 slidable within the pistol interface portion 374.

Similarly to the trigger lock assembly 200, the embodiments of the trigger lock assembly 300 place the pistol P into a locked state by blocking access to the pistol trigger TP such that a user cannot reach and actuate the pistol trigger TP until the trigger door members 378 retract within the vertical slots 376 of the pistol interface portion 374. In this regard, the trigger door members 378 retract forward into the pistol interface portion 374 mounted on the accessory rail of the pistol P. In some embodiments, the pistol interface feature 302 is adapted to mount to different styles of accessory rails, such as a "picatinny" style rail. In other embodiments, the pistol interface feature 302 is adapted to mount to a pistol P without an accessory rail.

As shown in FIGS. 9 and 10, in some embodiments, the trigger lock assembly 300 has a laser sight 380 to include the functionality of other types of accessories that are traditionally mounted to the accessory rail. In other embodiments, other functionality is included with the trigger lock assembly 300 in conjunction or in place of the laser sight 380, such as a light source, a rail mount extension, a rail mount transfer above the pistol P, a bayonet mount, a rest (bipod, etc.), a folding grip extension, or any other suitable integrated accessory.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A firearm trigger locking system, comprising:

a grip portion couplable to a firearm body having a trigger external to the firearm body and graspable by a user;

an authentication system operatively associated with the grip portion, the authentication system comprising:

a central processing unit;

a storage device in communication with the central processing unit, the storage device capable of storing an authorization key;

an identification component in communication with the central processing unit, the identification component capable of recognizing the authorization key;

an actuator in communication with the central processing unit, the actuator activatable by the central processing unit when the identification component recognizes the authorization key; and a battery in communication with the central processing unit;

a trigger interference member moveable within a slot formed in the grip portion, the trigger interference member protruding from the grip portion and configured to abut the trigger in a first interference position, wherein the trigger interference member is configured to partially enclose a portion of the firearm body adjacent the grip portion; and a block moveable by the actuator from a first position to a second position when the identification component recognizes the authorization key, wherein the block abuts the trigger interference member in the first position to prevent movement of the trigger interference member within the slot for preventing actuation of the trigger.

2. The firearm trigger locking system of claim 1, further comprising a continuous firing button configured to maintain the block in the second position while the continuous firing button remains depressed.

3. The firearm trigger locking system of claim 1, wherein the block is moveable from the second position back into the first position when the identification component fails to recognize the authorization key to prevent movement of the trigger interference member within the slot for preventing actuation of the trigger.

4. The firearm trigger locking system of claim 1, further comprising a cover portion removably coupled to the grip portion, wherein the cover portion prevents access to internal components of the grip portion.

5. The firearm trigger locking system of claim 4, wherein the cover portion prevents unauthorized removal of the firearm trigger locking system from the firearm.

6. The firearm trigger locking system of claim 1, further comprising a manual override apparatus for the authentication system.

7. The firearm trigger locking system of claim 6, wherein the manual override apparatus is selected from the group consisting of a combination lock, a dial lock, a keyed lock, and a security bit tool fastener.

8. The firearm trigger locking system of claim 1, wherein the identification component is selected from the group consisting of a radio frequency identification sensor, a fingerprint scanner, a heartbeat signature recognition sensor, and a retina scan identification sensor.

9. The firearm trigger locking system of claim 1, wherein the identification component comprises a radio frequency identification sensor configured to receive the authorization key from a separate component external to the firearm trigger locking system embedded with the authorization key.

10. The firearm trigger locking system of claim 1, wherein the grip portion is configured to interface a grip mounting area of the firearm.

11. The firearm trigger locking system of claim 10, wherein the grip mounting area is a grip mounting area of an Assault Rifle platform firearm.

12. The firearm trigger locking system of claim 1, further comprising a status indicator configured to provide a visible system status to a user.

13. The firearm trigger locking system of claim 12, wherein the status indicator provides the visible system status of one or more of locked, unlocked, charging of the battery, RFID authentication, enrollment mode status, manual lock override, system fault, low battery warning, and unauthorized movement of the firearm.

14. The firearm trigger locking system of claim 1, further comprising a global positioning satellite (GPS) system configured to provide location information of the firearm.

15. The firearm trigger locking system of claim 1, further comprising an accelerometer system configured to detect an unauthorized movement of the firearm.

16. A firearm grip assembly with an automated authenticating trigger locking feature, comprising:

a handle graspable by a user and couplable to a firearm body having a trigger external to the firearm body, the handle including a firearm interface portion configured to interface the firearm body;

an authentication system disposed within the handle that is capable of transitioning a trigger of the firearm from a locked state to an unlocked state, the authentication system comprising:

a central processing unit;

a battery in communication with the central processing unit, the battery configured to be selectively isolated from the central processing unit by a switch;

an identification component in communication with the central processing unit, the identification component capable of selectively authenticating a user; and an actuator in communication with the central processing unit, the actuator activatable by the central processing unit when the identification component authenticates the user to transition the trigger of the firearm from the locked state to the unlocked state;

a slot formed in the handle to slidingly receive a trigger interference member protruding from the handle and configured to abut the trigger in a first interference position, wherein the trigger interference member is configured to partially enclose a portion of the firearm body adjacent the handle; and a continuous firing button disposed within the handle and movable from a first position to a second position, wherein the continuous firing button is configured to activate the switch upon movement from the first position to the second position, maintain the trigger of the firearm in the unlocked state in the second position, and transition the trigger of the firearm from the unlocked state to the locked state upon movement from the second position to the first position.

17. The firearm grip assembly of claim 16, further comprising a slidable block moveable by the actuator, wherein the slidable block is configured to abut the trigger interference member to prevent movement of the trigger interference member in the locked state.

18. The firearm grip assembly of claim 16, further comprising a cover portion removably coupled to the handle, wherein the cover portion prevents access to internal components of the handle and unauthorized removal of the firearm grip assembly from the firearm.

19. The firearm grip assembly of claim 16, wherein the handle is configured to interface a grip mounting area of the firearm.

20. The firearm grip assembly of claim 16, wherein the firearm interference portion is configured to partially enclose a trigger guard coupled to the firearm body.

21. A firearm with a trigger locking system, comprising:

a firearm including a body and a trigger, the trigger having a portion external to the body;

a grip portion graspable by a user and removably coupled to the firearm body, the grip portion enclosing an authentication system, the authentication system comprising:

a central processing unit;

a storage device in communication with the central processing unit, the storage device capable of storing an authorization key;

an identification component in communication with the central processing unit, the identification component capable of recognizing the authorization key;

an actuator in communication with the central processing unit, the actuator activatable by the central processing unit when the identification component recognizes the authorization key; and a battery in communication with the central processing unit;

a trigger interference member abutting the trigger portion external to the firearm body in a first interference position, wherein the trigger interference member is moveable within a slot formed in the grip portion, and wherein the trigger interference member partially encloses a portion of the firearm body adjacent the grip portion; and a block moveable by the actuator from a first position to a second position when the identification component recognizes the authorization key, wherein the block abuts the trigger interference member in the first position to prevent movement of the trigger interference member within the slot for preventing actuation of the trigger.

22. The firearm of claim 21, further comprising a continuous firing button configured to maintain the block in the second position while the continuous firing button remains depressed.

23. The firearm of claim 21, wherein the block is moveable from the second position back into the first position when the identification component fails to recognize the authorization key to prevent movement of the trigger interference member within the slot for preventing actuation of the trigger.

24. The firearm of claim 21, further comprising a manual override apparatus for the authentication system selected from the group consisting of a combination lock, a dial lock, a keyed lock, and a security bit tool fastener.

25. The firearm of claim 21, wherein the identification component is selected from the group consisting of a radio frequency identification sensor, a fingerprint scanner, a heartbeat signature recognition sensor, and a retina scan identification sensor.

26. The firearm of claim 21, wherein the identification component comprises a radio frequency identification sensor configured to receive the authorization key from a separate component external to the firearm trigger locking system embedded with the authorization key.

27. The firearm of claim 21, wherein a status indicator provides visible system status of one or more of locked, unlocked, charging of the battery, RFID authentication, enrollment mode status, manual lock override, system fault, low battery warning, and unauthorized movement of the firearm.

28. The firearm of claim 21, further comprising an accelerometer system configured to detect an unauthorized movement of the firearm.

* * * * *